US006041709A

United States Patent [19]

Wells et al.

[11] Patent Number: 6,041,709

[45] Date of Patent: Mar. 28, 2000

[54] PERISTALTIC PUMP FOR PUMPING INK OR CLEANING FLUIDS IN A PRINTING MACHINE

[75] Inventors: Robert Ray Wells, Charlotte; George Nick Hochman, Concord, both of N.C.

[73] Assignee: USAdvantage, Inc., Charlotte, N.C.

[21] Appl. No.: 09/190,593

[22] Filed: Nov. 12, 1998

[51] Int. Cl.[7] ..... B41F 31/08

[52] U.S. Cl. ..... 101/366; 101/350.6; 417/477.3; 417/475; 417/477.1

[58] Field of Search ..... 101/335, 350.1, 101/350.6, 349.1, 348, 480, 494, 366; 417/477.11, 477.3, 475, 477.1

[56] References Cited

U.S. PATENT DOCUMENTS

| | | | |
|---|---|---|---|
| 3,111,897 | 11/1963 | Buskirk | 101/350.5 |
| 3,116,688 | 1/1964 | Ward, Jr. et al. | 101/350 |
| 3,630,146 | 12/1971 | Shields | 101/351 |
| 3,739,717 | 6/1973 | Brown et al. | 101/366 |
| 3,793,952 | 2/1974 | Neumann et al. | 101/157 |
| 3,878,780 | 4/1975 | Lotte | 101/119 |
| 3,930,445 | 1/1976 | Jaffa | 101/120 |
| 4,138,205 | 2/1979 | Wallach . | |
| 4,169,425 | 10/1979 | Wohrle | 118/665 |
| 4,179,246 | 12/1979 | Guttmann . | |
| 4,192,709 | 3/1980 | Dunlap | 162/111 |
| 4,231,725 | 11/1980 | Hogan . | |
| 4,351,264 | 9/1982 | Flaum et al. | 118/203 |
| 4,396,648 | 8/1983 | Holt et al. | 427/356 |
| 4,440,809 | 4/1984 | Vreeland | 427/356 |
| 4,441,867 | 4/1984 | Berelson | 417/475 |
| 4,461,211 | 7/1984 | Wesselmann et al. | 101/366 |
| 4,552,516 | 11/1985 | Stanley . | |
| 4,590,855 | 5/1986 | Schommer et al. | 101/157 |
| 4,665,859 | 5/1987 | Dunlap et al. | 118/126 |
| 4,821,672 | 4/1989 | Bruno | 118/261 |
| 4,834,630 | 5/1989 | Godwin | 417/475 |
| 4,839,201 | 6/1989 | Rantanen et al. | 427/355 |
| 4,852,604 | 8/1989 | Wales et al. | 101/364 |
| 5,003,876 | 4/1991 | Harrison et al. | 101/350 |
| 5,103,732 | 4/1992 | Wells . | |
| 5,697,299 | 12/1997 | Umetani et al. | 101/366 |

OTHER PUBLICATIONS

Graymills Corporation, Peristaltic Pump, pp. 1–3, 1995.

*Primary Examiner*—John S. Hilten
*Assistant Examiner*—Daniel J. Colilla
*Attorney, Agent, or Firm*—St. Clair & Wilson; Robert D. Marchant

[57] ABSTRACT

A peristaltic type pump for pumping ink to a printing section of a corrugated paperboard finishing machine capable of both pumping ink to the printing section and pumping excess ink from the printing section back to an ink supply as well as pumping a cleaning fluid to the printing section and pumping excess cleaning fluid back to a sump. The pump includes at least one pumping element for pumping the ink or cleaning fluid to the printing section and at least one but preferably two pumping elements for pumping the excess ink or excess cleaning fluid back to the ink supply or sump respectively. Each pumping element includes a rotor having at least two but preferably three or more lobes for compressing two portions of a semicircular portion of a flexible tube surrounding the rotor to confine a finite quantity of ink or cleaning fluid in the tube between two of the lobes in sucession during rotation of the rotor to force the ink or cleaning fluid from an inlet to an outlet of the pump.

19 Claims, 5 Drawing Sheets

PERISTALTIC PUMP FOR PUMPING INK OR CLEANING FLUIDS IN A PRINTING MACHINE

BACKGROUND OF THE INVENTION

1. Field of the Invention

This invention relates generally to apparatus for pumping fluids and more particularly to apparatus for pumping liquid ink and cleaning fluids to the printing sections of printing machines for corrugated paperboard.

2. Brief Description of the Prior Art

Conventional printing sections utilize anilox and doctor rolls to place a film of ink on a printing plate. Alternatively, doctor blades of various configurations are used in place of a doctor roll in conjunction with the anilox roll and, sometimes, both a doctor roll and a doctor blade are used alternatively in the same printing section. An example of a printing apparatus pertinent to this invention is shown in Wells et al U.S. Pat. No. 5,103,732, the disclosures of which are incorporated herein by reference. This patent shows an anilox/doctor roll configuration as well as an anilox/doctor blade configuration.

A diaphragm pump is the type most commonly used in the corrugated industry. A diaphragm pump utilizes reciprocally operable resilient diaphragms to suck liquid in the bottom of the pump and force it out the top [or vice versa] along with conventional duckbill valves to control the direction of flow. Such pumps are available from Aro Corporation, Aro Center, Bryan, Ohio 43506. Model 666053-021 is typical. This pump is also made in a dual diaphragm model with two inlets and two outlets to provide a right and left side pump.

Currently used pumps usually have only one inlet and one outlet. Therefore, a separate pump is required for each printing section of a machine, it being understood that each section applies a different ink color. Most printing machines have two printing sections, often three, and sometimes four. If it is desired to also pump the excess ink back to the ink supply rather than use a gravity return, then two more separate pumps would be required for each printing section since each printing section has two drains for the ink, one on each side of the printing section. Therefore, even when a dual diaphragm pump is used, only one inlet/outlet is available for pumping excess ink back to the ink supply.

In the operation of printing machines, such as referred to in the aforementioned patent, it is not uncommon to change ink colors several times during a shift because many orders are for short runs. When a color change is made, it is necessary to thoroughly clean the entire ink system, including ink rolls, doctor blades, and supply and drain lines as well as the ink pumps themselves to prevent contamination of the new ink.

A first considerable disadvantage of the diaphragm pump is that it is difficult to clean because of its many parts and surfaces to which the ink adheres. Such pumps are unidirectional and cannot be backwashed so that cleaning is not totally effective besides being time consuming. Backwashing means the ability to run a pump in both forward and reverse directions so that a cleaning fluid can flush ink from the parts that might normally escape cleaning from the cleaning fluid flowing in only one direction.

A second considerable disadvantage is that a relatively large volume of ink remains in the pump and the ink supply line to the pump when the pump is turned off prior to cleaning. With the current cost of ink being about $4.00 to $8.00 per pound, the cost of ink currently wasted in such parts is considerable. In addition, considerable costs are incurred for the wash water or other cleaning fluid because the pumps are difficult to clean.

Another considerable disadvantage of such pumps is that they tend to cause a positive ink pressure in the enclosed chamber of closed-chamber doctor blade systems, causing the ink to leak through the end seals (and sometimes between the doctor blades and anilox roll as well). Ink leaking at the ends of the anilox roll beyond the end seals often results in ink slinging which can damage the product being printed. But, if the ink chamber does not remain full of ink, the ink chamber can go dry, resulting in non-printing and even damage to the anilox roll. Less serious but still troublesome disadvantages are that such pumps tend to deliver the ink in surges rather than in an even flow. And, such pumps are subject to stalling at slow speed, particularly when high viscosity inks are being used.

Accordingly, an object of this invention generally is to overcome the disadvantages of current ink pumps. More particularly, it is an object of this invention to provide a pump that can both pump ink to a printing section and pump excess ink from the printing section.

Another object of this invention is to provide a pump that can be run in a reverse direction to pump ink remaining in the pump, and in the ink supply line between an ink supply and the pump, back to the ink supply.

Another object of this invention is to provide a pump that can be backwashed to more efficiently remove ink remaining therein.

Another object of this invention is to provide a single pump that can be used to pump a different color ink to each of several printing sections simultaneously.

These and other objects and novel features will become more apparent from the following detailed description when read in connection with the accompanying drawings.

SUMMARY OF THE INVENTION

The improved apparatus of this invention comprises a bidirectional ink pump having three rotatable pumping elements, each element including an ink inlet and an ink outlet, in a single housing. A flexible hollow tube connects the inlet and outlet of each element and rests against a curved inner surface portion of the housing. A rotor for each tube is mounted for rotation by a single drive shaft within the housing. The rotor for the first pumping element has three equally spaced lobes thereon, two of which compress the portions of the tube adjacent the lobes against the curved portion of the housing, the third lobe being out of contact with the tube. This confines a finite volume of ink in the tube between the compressed portions of the tube. As the rotor rotates, the two lobes force the confined volume of ink in the tube to move from the inlet to the outlet side of the pumping element. During rotation, the third lobe becomes one of the two lobes confining a finite portion of ink as the first lobe comes out of contact with the tube on the outlet side. And, as the rotor rotates, succeeding lobes trailing the finite volume of ink creates suction in an ink supply line connected to the inlet to keep a constant supply of ink flowing to the inlet and through the pump.

The other two pumping elements in the pump each have a rotor with four equally spaced lobes thereon, two of which confine a finite volume of ink in the tube, in the same manner as set forth above, that is smaller in volume than the finite volume of ink created by the three-lobed rotor.

The inlet of the three-lobed pumping element is connected to an ink line from an ink supply and the outlet is connected to an ink line running to the ink system being used. The inlet of one of the four-lobed pumping elements is connected to an excess ink return line from the ink system and its outlet is connected to a return ink line to the ink supply. The inlet of the other four-lobed pumping element is connected to another excess ink return line from the ink system and its outlet is connected to another ink return line to the ink supply. The ink systems in use today usually have two excess ink drains, one at each end of the anilox roll. In this manner, ink is continuously circulated through the system.

Since all of the rotors turn at the same velocity, the three-lobed pumping element pumps ink to the ink system at a volumetric rate greater than the volumetric rate at which either of the four-lobed pumping elements withdraws the excess ink but, together, the four-lobed pumping elements pump a greater volume of ink back to the ink supply. Thus, ink in the fountain does not overflow, which sometimes happens when heavy inks do not flow back to the ink supply fast enough in gravity return lines.

The ink pump serves to wash the ink system as well as supply it with ink. First, the pump is run in the reverse direction. This empties the ink in the pump and in the supply line back into the ink supply thereby saving a significant quantity of ink. The ink drain lines from the pump to the ink supply are not immersed in the ink. Therefore, while the pump is running in the opposite direction, the suction in those lines only pump air and do not pump ink into the drain lines between the pump and the ink system.

Then, the ink supply line from the ink supply is placed in a cleaning fluid and the excess ink return lines from the pump are placed in a soiled cleaning fluid receptacle (hereinafter referred to as a sump). Then the pump is run in a forward direction to circulate the cleaning fluid throughout the entire ink system until the cleaning fluid runs clear. This cleans the ink supply lines, the fountain (including the anilox and doctor rolls or anilox roll and doctor blade as the case may be), and the ink return lines. Some additional manual cleaning of the anilox roll and doctor roll or doctor blade is sometimes required.

After the system is cleaned as set forth above (hereinafter, use of the word "system" refers to the ink pump; the printing section including anilox roll/doctor roll or anilox roll/doctor blade and associated end dams, seals and associated parts as the case may be; and the ink supply and excess ink return lines), the excess ink return lines from the pump to the sump are placed in the cleaning fluid supply and the ink supply line from the ink supply to the pump is placed in the sump. The direction of rotation of the pump is reversed and the cleaning fluid pumped through the foregoing ink lines and pump in a reverse direction to backwash the last vestiges of ink from them.

For an ink system using an anilox roll and a closed-chamber doctor blade, after the ink in the supply line and pump has been emptied into the ink supply as set forth above, the ink supply line is connected to the cleaning fluid supply and the ink discharge lines are placed in the sump and the pump is run in the forward direction until the fluid runs clear. This cleans the entire ink system, including the closed-chamber doctor blade. To backwash the entire system, it is only necessary to switch the drain lines and the ink supply line between the cleaning fluid and the sump and run the pump in the reverse direction.

The user may provide quick-disconnect fittings for the ends of the appropriate ink lines to make switching of the ink lines between the ink supply and the cleaning fluid easier.

Added versitility is achieved by a pump configuration in which all of the pump elements have three-lobed rotors. This enables the pump to supply ink to three printing sections in the printing machine by pumping a different color ink with each of the three pump elements with the outlet of each element being connected to an ink supply line running to the fountain of each section and using gravity excess ink return lines. It is also possible to add a two-rotor pump to each print section to pump the excess ink from the two drains in each section back to the ink supply.

BRIEF DESCRIPTION OF THE DRAWINGS

In the drawings wherein like parts are marked alike.

DESCRIPTION OF THE PREFERRED EMBODIMENT

For a full understanding of the invention, it is better to first understand the environment in which it works.

Figure 5:
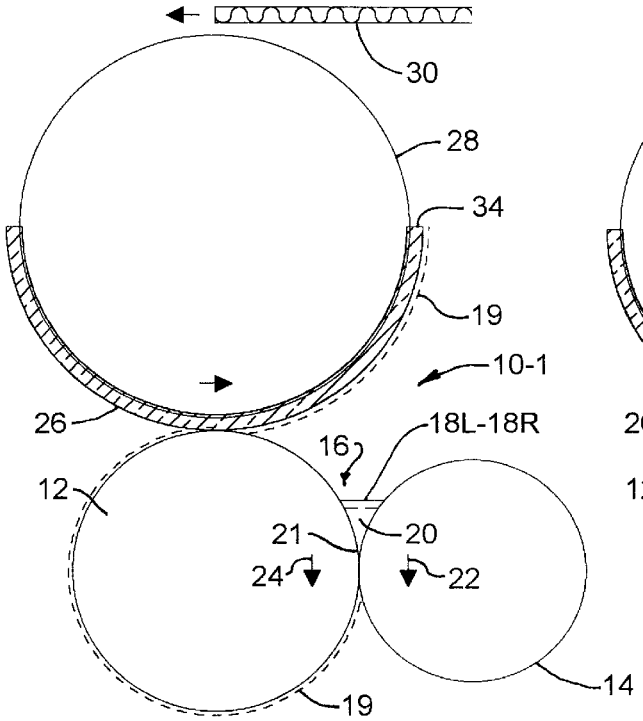
FIG. 5 is a schematic illustration of a printing section showing a print cylinder with a printing die attached, a corrugated paperboard sheet to be printed, an anilox roll in contact with the printing die, a doctor roll in contact with the anilox roll, and the ink fountain formed by the anilox and doctor rolls.

FIG. 5 schematically illustrates the essential parts of a printing section 10-1 necessary for an understanding of this invention. Printing section 10-1 includes an anilox roll 12 against which a doctor roll 14 is located. These rolls form an ink fountain 16 together with end dams 18L and 18R at opposite ends of the rolls to hold the ink 20 in a nip 21 between the rolls.

The ceramic peripheral surface of anilox roll 12 is finely engraved to create minute pockets (not shown) for carrying ink therein; and, the peripheral surface of doctor roll 14 is rubber covered, both being well understood by those skilled in the art.

As the rolls 12 and 14 turn in the directions shown by arrows 22 and 24, a film 19 of ink 20 is squeezed into the pockets on the anilox roll 12 by the doctor roll 14 for transfer to a rubber (or photo-polymer) printing die 26, secured to a rotating print cylinder 28, arranged to lightly touch the anilox roll 12 as the die 26 passes it. The ink film 19 on die 26 is then transferred to a sheet of corrugated paperboard 30 arranged to pass in tangential contact with the die 26 as the print cylinder 28 rotates and the sheet 30 advances linearly through the printing section 10-1.

The sheet 30 is shown in the position it will be in when the printing die 26 reaches it, the leading edge 34 of the die 26 reaching the 12 o'clock position at the same time as the leading edge of the sheet 30, that is, in register. Often the die 26 will not be as large as the sheet 30, so the leading edge 34 of the die is positioned on the print cylinder 28 so as to register with a particular location on the sheet as well understood by those skilled in the art. It should be understood that the printing die 26 has patterns embossed thereon (not shown) which pick up ink from the anilox roll 12. Ink film 19 left on the anilox roll 12 in the non-pattern areas of the die 26 is returned to the fountain 16 as the anilox roll 12 continues to rotate. More ink 20 is pumped into the fountain 16 than will be needed to wet the the embossed areas of the die to ensure that the die will have sufficient ink 20 to print on the sheet 30. Ink is supplied to the fountain 16 continuously and the excess ink 20 in the fountain is returned to the ink supply as it accumulates.

Figure 11:
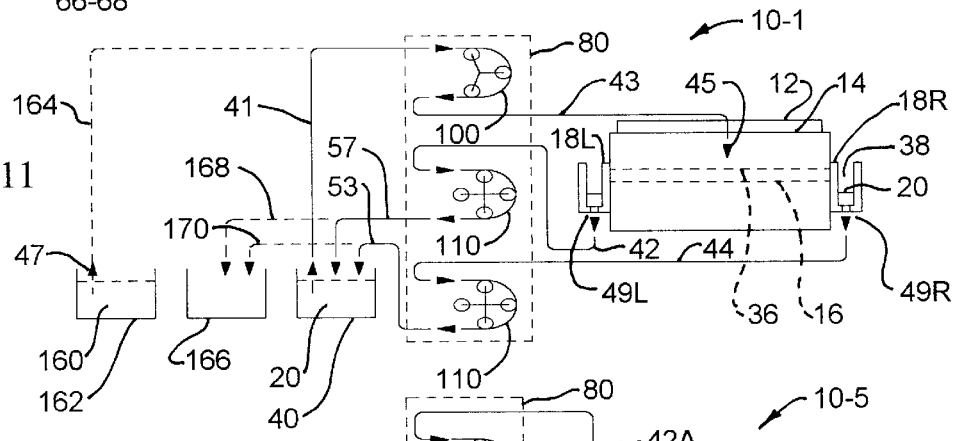
FIG. 11 is a schematic illustration of an ink supply system for an anilox roll/doctor roll type system using an ink pump with a three lobed pumping element supplying the ink and two four lobed pumping elements, one for each drain, pumping excess ink back to the ink supply.

For further understanding of the invention, reference may be made to FIG. 11 which schematically illustrates, in front view, the doctor roll 14 and the end dams 18L and 18R of FIG. 5, and the top level 36 of ink 20 stretching across the fountain 16 between the end dams 18L, 18R. Excess ink 20 in the fountain 16 overflows the end dams 18L, 18R into a reservoir portion 38 thereof. Excess ink 20 in the reservoirs 38 flows back to an ink supply 40 through drain lines 42 and 44.

FIG. 11 also schematically illustrates an ink pump 80 of the present invention in essence comprising an ink supply pumping element 100 for supplying ink to the printing section 10-1, an excess ink pumping element 110 for the left side dam 18L, and another excess ink pumping element 110 for the right side dam 18R for returning the excess ink back to the ink supply 40. The ink pump 80 will be described in greater detail further on.

Still referring to FIG. 11, in conventional ink systems, the ink supply pumping element 100 would be replaced by a diaphragm ink pump. Ordinarily, the excess ink would be returned to the ink supply by gravity through ink lines that slope to the ink supply. It is not uncommon for the ink to overflow from the reservoirs 38 of the dams 18L, 18R. Even when excess ink return pumps are used, separate individual ink pumps (of the same type as the ink supply pump) are required for both ink return lines.

Figure 6:
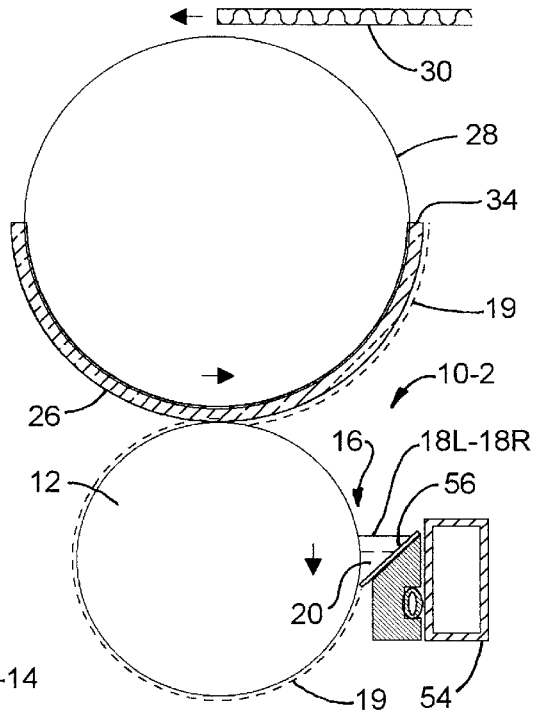
FIG. 6 is a schematic illustration of a printing section similar to FIG. 5 in which a single trailing doctor blade has been substituted for the doctor roll to form the ink fountain.

FIG. 6 is similar in all pertinent respects to FIG. 5 except that the doctor roll 14 has been replaced by a trailing doctor blade assembly 54 resulting in an ink system denoted by numeral 10-2. Operation of the ink system 10-2 is the same as for ink system 10-1 except that a blade 56, rather than a doctor roll, squeezes the ink 20 onto the anilox roll 12.

Figure 7:
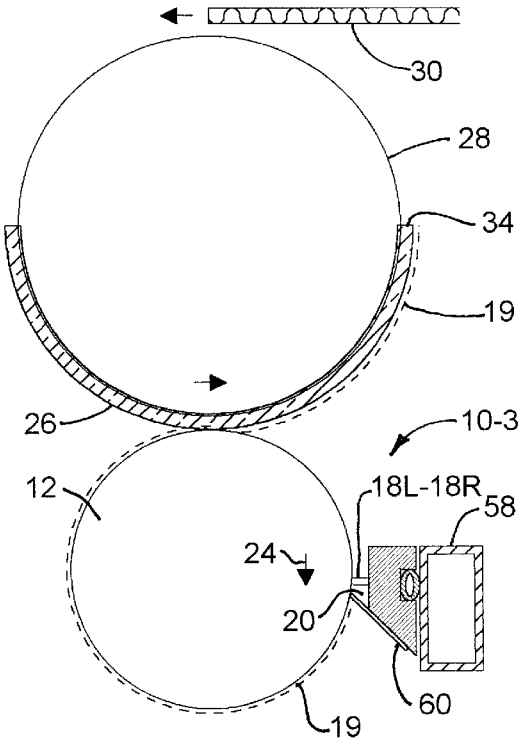
FIG. 7 is a schematic illustration of a printing section similar to FIG. 5 in which a single reverse-angle doctor blade has been substituted for the doctor roll to form the ink fountain.

FIG. 7 is similar in all pertinent respects to FIG. 6 except that the trailing doctor blade assembly 54 has been replaced by a reverse angle doctor blade assembly 58 resulting in an ink system denoted by numeral 10-3. Operation of the ink system 10-3 is the same as for the ink system 10-2 except that a blade 60, opposite in inclination to blade 56, squeezes the ink 20 onto the anilox roll 12.

Figure 8:
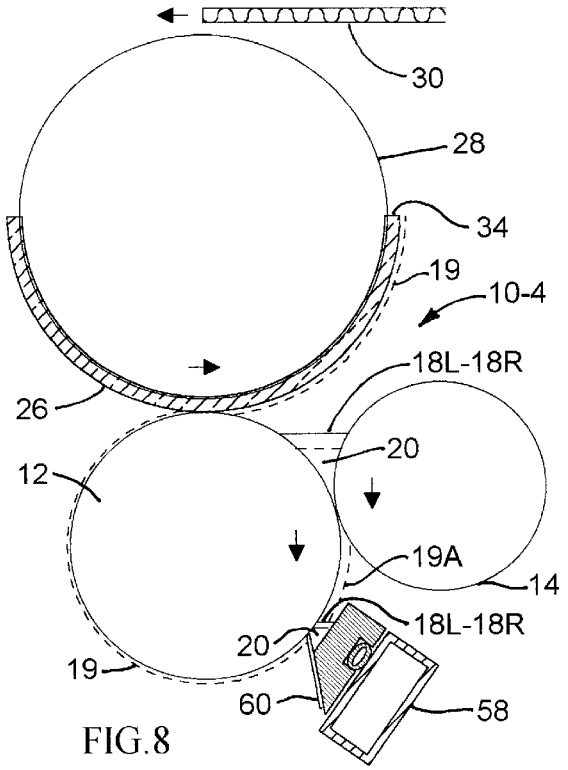
FIG. 8 is a schematic illustration of a printing section similar to FIG. 5 in which a doctor roll is used to pre-meter the ink film on the anilox roll and a reverse angle doctor blade is used for final metering.

FIG. 8 is similar in all pertinent respects to a combination of ink systems 10-1 and 10-3 in that the resultant ink system 10-4 uses both a doctor roll 14 and a reverse angle doctor blade assembly 58. Operation of system 10-4 is the same as in both systems 10-1 and 10-3 except that the doctor roll 14 is used to pre-meter a film of ink 19A onto the anilox roll 12, which ink film 19 is more precisely metered by the doctor blade 60 onto the anilox roll 12. The drain lines 42 and 44 for the doctor roll 14 (FIG. 11) may be connected to the drain lines 42A and 44A for the reverse angle doctor blade 58 (FIG. 12) so that only one pump element 110 is needed for each pair of drains 42/42A and 44/44A.

Figure 9:
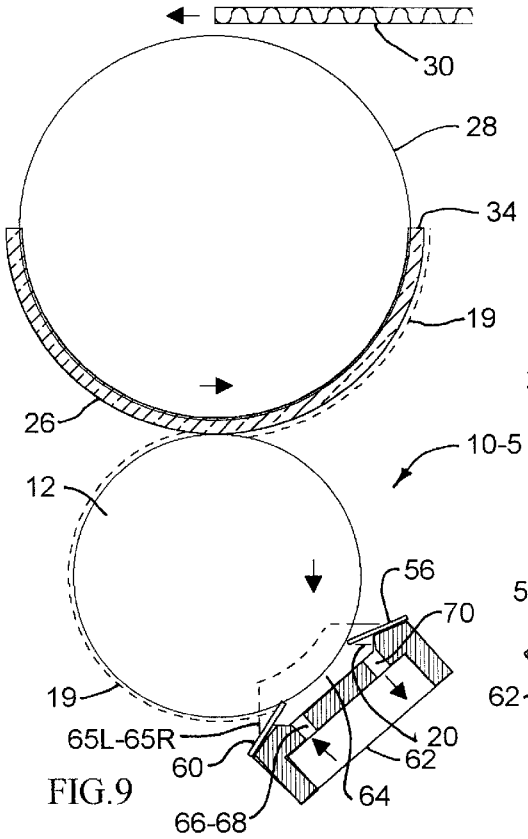
FIG. 9 is a schematic illustration of a printing section similar to FIG. 5 showing a closed-chamber doctor blade in place of a doctor roll.

FIG. 9 is similar in all pertinent respects to a combination of the ink systems 10-2 and 10-3 in that the resultant ink system 10-5 uses both a trailing doctor blade 56 and a reverse angle doctor blade 60 supported by the same holder 62. In this configuration, the end dams 65L and 65R (shown schematically in FIG. 12) are configured to seal the ends of the ink chamber 64 in conjunction with the blade holder 62 and the anilox roll 12. Hence, the term "closed-chamber doctor blade."

In the ink system 10-5 (when a conventional diaphragm pump is used to supply the ink and the excess ink in the chamber 64 is returned to the ink supply by gravity), ink 20 is supplied to the chamber 64 through supply inlet 66 on the left end. The excess ink 20 first flows out of lower drain outlet 68 (shown in FIG. 12) on the right end opposite the supply inlet at a volumetric rate less than the volumetric rate at which it is supplied. This causes the ink level to rise in the chamber 64 until it reaches an upper drain outlet 70 above the supply inlet 66. The drain outlet 70 is the same size as the lower drain outlet 68 but their combined cross section is larger than the cross section of the supply inlet 66. Thus, the ink 20 will rise in the chamber 64 until it flows into the drain outlet 70. At this time, the ink level may oscillate slightly between just below outlet 70 to just above the lower part of the outlet. In this manner, the ink 20 in the chamber 64 is kept at a neutral or slightly negative pressure (vacuum) inside the ink chamber 64. Put another way, this prevents the ink from being under a positive pressure in the ink chamber 64. However, when heavy viscous ink is being used, gravity drains are not always sufficient and ink pressure builds up in the chamber 64, causing ink to be forced out between seal portions (not shown but well known by those skilled in the art—see U.S. Pat. No. 5,103,732 referred to herein) of the end dams 65L and 65R. Therefore, it is desirable to be able to pump the excess ink 20 back to the ink supply 40 at a volumetric rate in excess of the volumetric rate at which it is supplied to the chamber 64 as the excess ink accumulates to maintain the ink 20 in the chamber 64 at a neutral or slightly negative (vacuum) pressure.

This is accomplished by the pump 80 of the present invention (to be described in greater detail) which has one pumping element 100 with three lobes for supplying the ink 20 to the ink chamber 64 and two pumping elements 110 (one for each drain 68 and 70), each with four lobes, which together pump the excess ink 20 in chamber 64 back to the ink supply 40 at a greater volumetric flow rate than the rate at which it is supplied regardless of the size of the drain holes 68 and 70.

Figure 10:
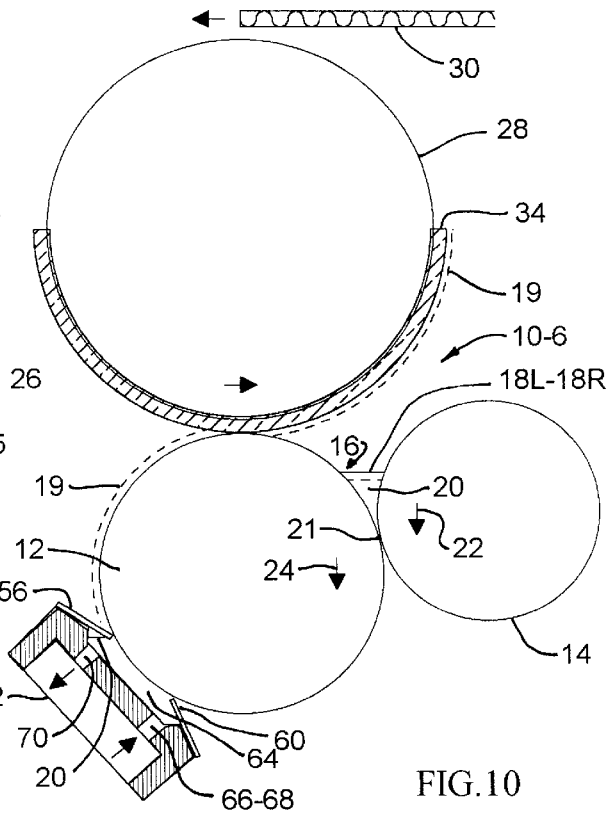
FIG. 10 is a schematic illustration of a printing section similar to FIG. 5 showing both a doctor roll and a closed-chamber doctor blade which are used alternatively.

FIG. 10 shows an ink system 10-6 which is merely a combination of the ink systems 10-1 (FIG. 5) and 10-5 (FIG. 9) with the closed chamber doctor blade 62 of FIG. 9 moved to the opposite side of the anilox roll 12. Ink system 10-6 includes the same parts as the individual systems of 10-1 and 10-5 except that only one pump 80 and the associated ink supply and supply and return lines shown in FIG. 11 need be used. These parts are connected either to the system 10-1 or 10-5, depending on which system is to be used. Generally, the doctor roll system 10-1 of FIG. 5 provides adequate printing but if higher quality printing is desired, it is sometimes advantageous to switch to the doctor blade system as well understood by those skilled in the art.

Figure 1:
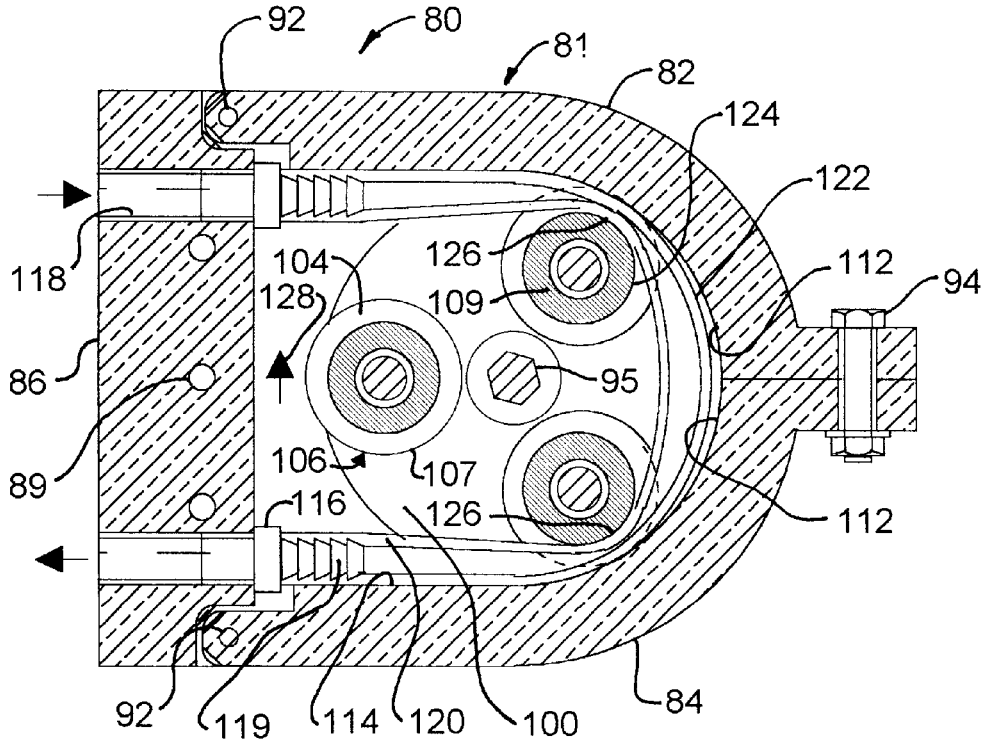
FIG. 1 is an end view in cross section taken along line A—A of FIG. 3 showing a three-lobed pumping element of the ink pump.
Figure 3:
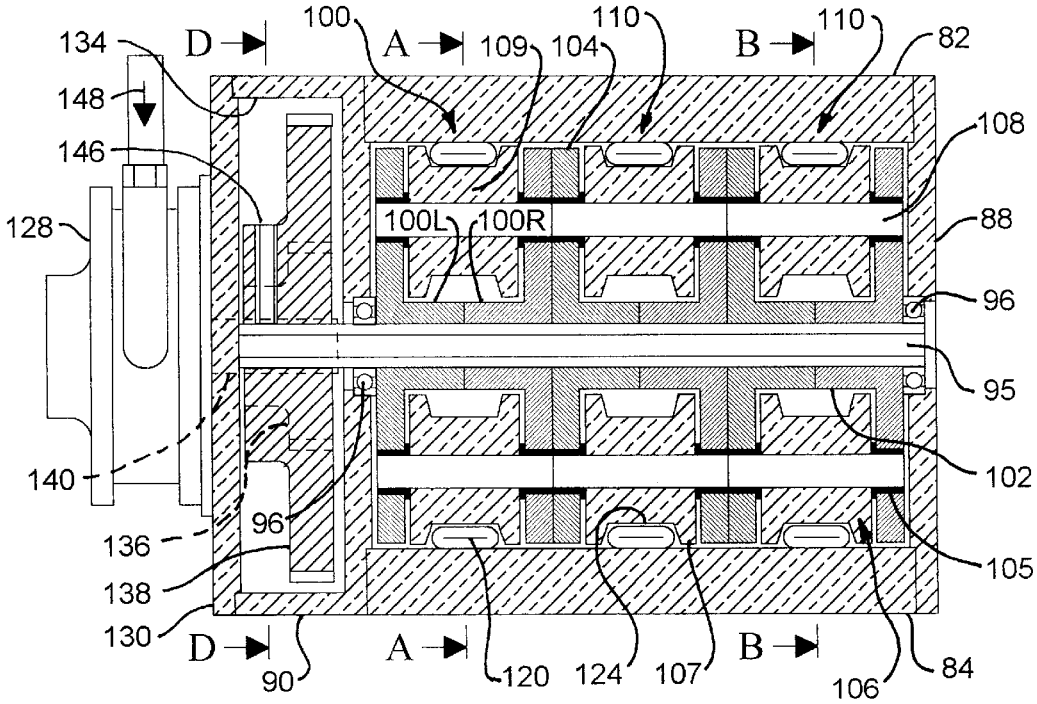
FIG. 3 is a front view in cross section taken along line C—C of FIG. 2 showing an ink pump having three pumping elements.

The pumping apparatus of this invention will be better understood by referring first to FIG. 1 and FIG. 3. A pump generally designated by numeral 80 includes a housing generally designated by numeral 81 comprised of a top lid 82, a bottom lid 84, a back plate 86, a right end plate 88, and a left end plate 90. The end plates 88 and 90 are secured to the back plate 86 with suitable fasteners threaded into threaded holes 89 shown in FIGS. 1 and 4 to provide a rigid assembly. The top lid 82 and bottom lid 84 are hinged to the end plates 88 and 90 by pins 92 to permit the lids 82 and 84 to be pivoted about pins 92 to an open position at 90 degrees to the closed position shown to permit access to the interior of the pump 80 for assembly and maintenance. Conventional fasteners 94 are spaced along the length of the lids 82 and 84 to secure the lids in the closed position for operation. The lids, backplate, and end plates can be made from most any rigid material such as steel, aluminum, or plastic but are preferably made from nylon. The lids 82 and 84 are preferably identical, one merely being turned upside down to form the housing 81 together with the back plate 86 and end plates 88 and 90.

A drive shaft 95 extends between end plates 88 and 90 and is mounted for rotation therein by bearings 96. Drive shaft 95 is hexagonal in cross-section; bearings 96 with a hexagonal bore to fit the drive shaft 95 are obtainable from bearing suppliers as a standard item.

A three-lobed rotor 100, as viewed in FIG. 1, is constructed from two identical halves 100L and 100R, as viewed in FIG. 3, each having an extended journal portion 102 facing the other and having radially extending flange portions 104 which, together with the journals, form the rotor 100 as an H in cross-section. The rotor is preferably made from the same material as the lids 82 and 84. One three-lobed rotor 100 is mounted on the left end of drive shaft 95 for rotation thereby.

The lobes of the rotor 100 comprise identical rollers 106 that are spool-shaped in cross-section, as viewed in FIG. 3, equally spaced at 120 degrees around the periphery of rotor 100. The rollers 106 are pressed on axles 108 which are mounted for rotation in the flanges 104 of the rotor 100. Conventional oil-impregnated brass bushings 105 are pressed in the flanges 104 so that the axle and roller freely rotate as a unit in the bushings. Roller 106 includes axially spaced flanges 107 connected by a cylindrical portion 109 of a diameter less than the diameter of the flanges 107. The rollers 106 are preferably made from the same material as the lids 82 and 84.

Figure 2:
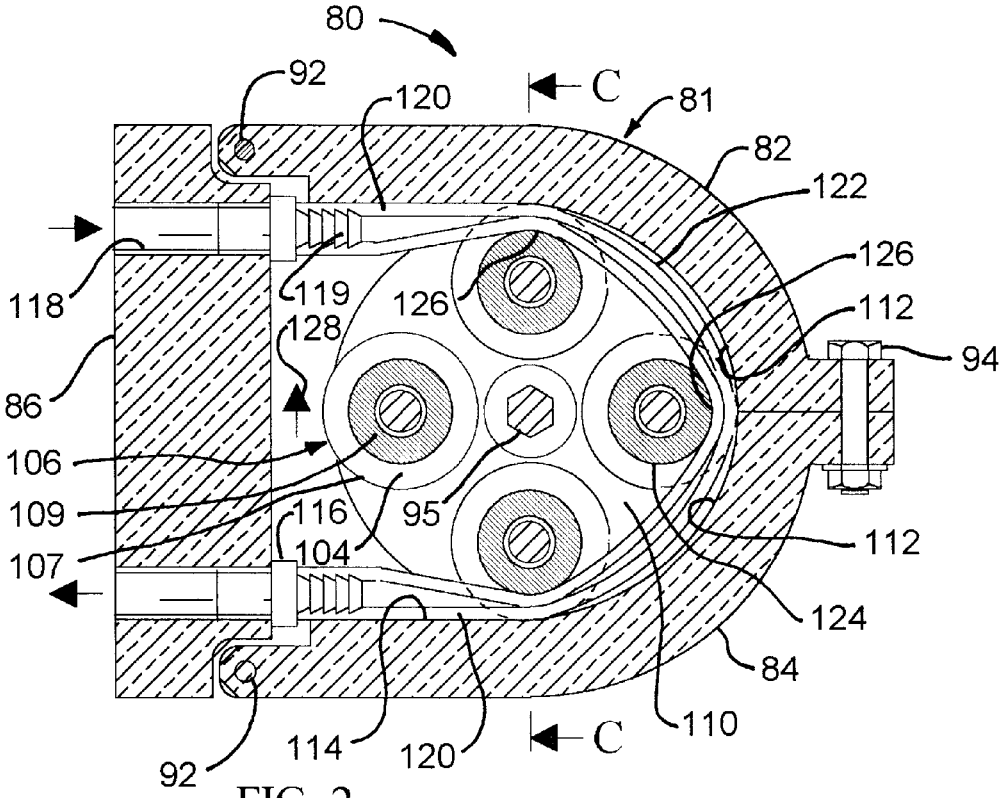
FIG. 2 is an end view in cross section taken along line B—B of FIG. 3 showing a four-lobed pumping element of the ink pump.

A four-lobed rotor 110 is shown in FIG. 2. It is constructed the same as the three-lobed rotor 100 except four rollers 106 are equally spaced at 90 degrees around the periphery of the flanges 104. The flanges 104 of the rotors 100 and 110 are preferably identical, each having a pattern of holes to accommodate either a set of three or a set of four rollers 106. Two four-lobed rotors 110 are mounted side-by-side on drive shaft 95 for rotation thereby on the right side of the three-lobed rotor 100 as shown in FIG. 3.

As viewed in FIG. 1, each lid 82 includes a symetrical curved interior surface 112 which together form a continuous curved surface extending from the 12 o'clock position on lid 82 to the 6 o'clock position on lid 84. The ends of the surface 112 extend in a horizontal direction, as indicated by numeral 114, to near the back plate 86 where the lids 82 and 84 are notched to accommodate pivoting of the lids as previously mentioned.

Conventional tube fittings 116 are threaded into threaded holes 118 in back plate 86 directly opposite the horizontal center of each rotor 100 and 110. The fitting 116 includes a serrated nozzle portion 119 to which a tube may be attached without the need for tube clamps.

A flexible tube 120, preferably made from a suitable plastic material, is attached to the fittings 116 and wound around the rollers 106 as shown in FIG. 1 and FIG. 2. The curved surfaces 112 are proportioned such that the outer surface 122 of tube 120 touches the curved surfaces when the tube is not compressed. The rollers 106 are equally radially-spaced on the roller flanges 104 so that the periphery 124 of cylindrical portion 109 of the roller 106 compresses a portion 126 of the tube 120 wherever the peripheral surface 124 is opposite the curved surfaces 112. The outer diameters of the flanges 107 of rollers 106 are made so as to slightly clear the curved surfaces 112 of the lids 82 and 84 but will have rolling engagement with the sides of the compressed portion of tube 120 so that the rollers 106 roll rather than slide against the tube 120. If desired, the surfaces 124 of rollers 106 may be made with a slight concave crown to keep the tube 120 centered thereon as well understood by those skilled in the art.

Figure 4:
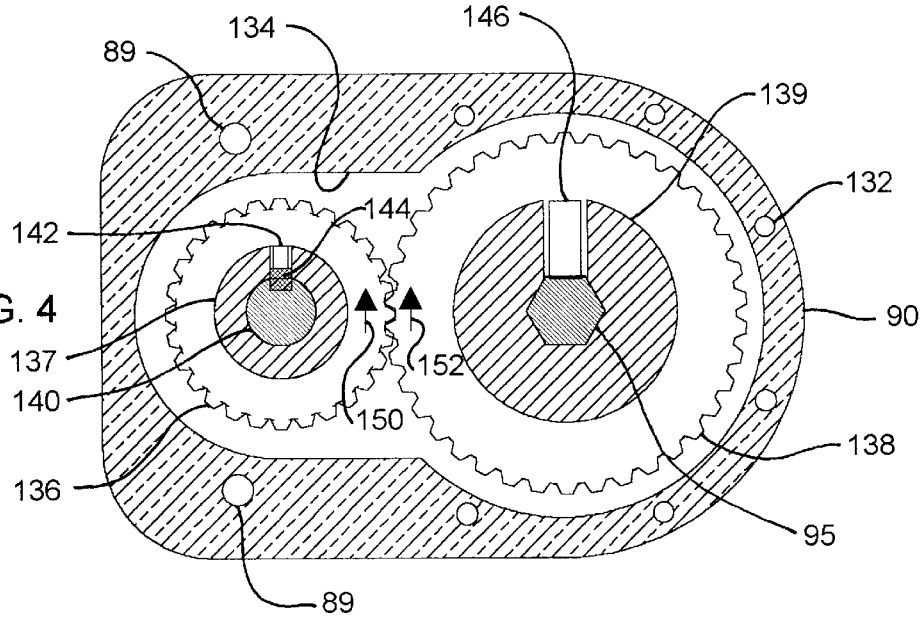
FIG. 4 is an end view in cross section taken along line D—D of FIG. 3 showing a drive gear on an air motor shaft meshing with a driven gear on the pump elements drive shaft.

The pump 80 is driven by a conventional bidirectional air motor 128, schematically illustrated in FIG. 3, suitably secured to an end cap 130 which is itself secured to end plate 90 by suitable fasteners threaded into the threaded holes 132 of end plate 90 shown in FIG. 4. A satisfactory air motor is available from Gast Manufacturing Corporation, 2300 Highway M-139, Benton Harbor, Mich. 49023, Model No. 6AM-NRV-7A. If desired, a variable speed, bi-directional electric motor may be used in lieu of the air motor 128.

As shown in FIGS. 3 and 4, end plate 90 is made with recessed portion 134 to accommodate conventionl spur-tooth gears 136 and 138. Drive gear 136 is mounted on air motor output shaft 140 extending from the air motor 128 through end cap 130 into the recess 134. A set screw 142 threaded in the hub 137 of gear 136 acts against a shaft key 144 to hold the gear 136 on output shaft 140 for rotation thereby.

Gear 138 is mounted on the rotor drive shaft 95 in meshing engagement with the drive gear 136. A set screw 146 threaded in the hub 139 of gear 138 acts against the shaft 95 to hold the gear 138 on shaft 95.

Air under a pressure of from 35 to 80 p.s.i. is supplied to air motor 128 as indicated by arrow 148 which causes output shaft 140 to turn gear 136 in the direction indicated by arrow 150. Gear 136 turns gear 138 in the direction of arrow 152 which turns rotor shaft 95 to run the pump 80 in a forward direction. The air motor 128 includes a valve (not shown) for reversing the direction of rotation of the air motor to run the pump 80 in a reverse direction.

The pump described in the Summary of the Invention (one three-lobed rotor for supplying the ink and two four-lobed rotors for pumping the excess ink back to the ink supply) is preferred for most applications. However, the pump can be configured in several ways. For example, rotors with only two lobes equally radially-spaced at 180 degrees thereon will work (not shown but evident from the description relating to FIGS. 1 and 2). But, using rotors with only two lobes sometimes results in pulsing of the ink in the supply lines which can be detrimental to printing. Therefore, rotors with at least three lobes are preferred.

The ink systems shown in FIGS. 5 to 10 show two end drains, one at each end of the anilox roll. However, in some older ink system designs, the ink is permitted to drain off both ends of the anilox roll into a single pan or trough beneath the anilox roll from which the excess ink is returned to the ink supply from a single outlet or drain in the center of the pan by gravity flow (not shown but well known by those skilled in the art). With this configuration, a pump with only a single pump element is required for supplying the ink to the print section. If it is desired to pump the excess ink back to the ink supply rather than relying on gravity return, then only another single pump element need be included in the pump housing. In this event, the ink return pump element will have fewer lobes than the ink supply pump element. It should be understood that a pump element with fewer lobes will pump more ink (greater volumetric flow rate) than one with more lobes.

Figures 13, 14:
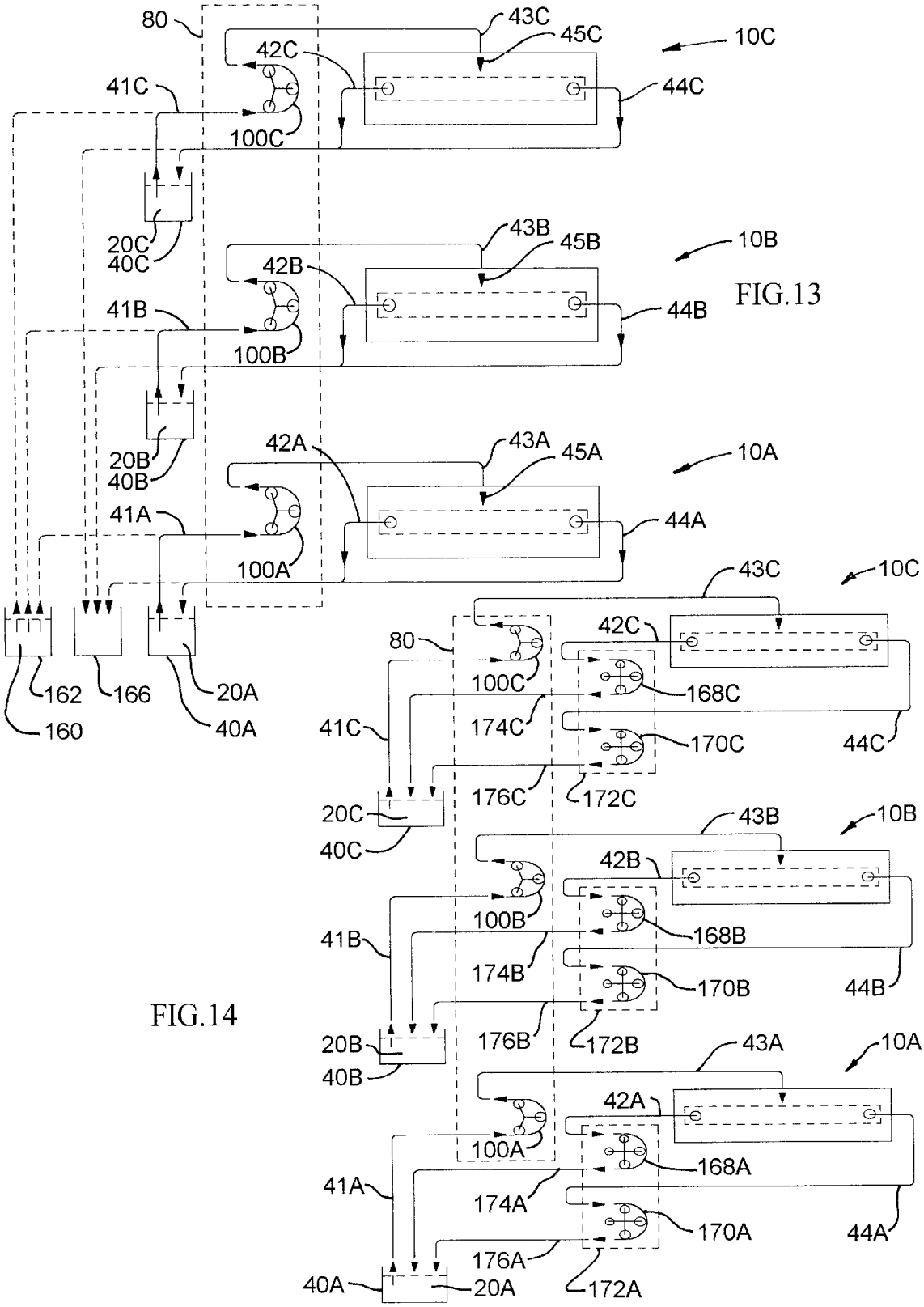
FIG. 13 is a schematic illustration of an ink supply system for three printing sections, of any of the types mentioned above (even if each section uses a different type), using a single ink pump to supply ink of a different color to each of the three printing sections, and using gravity return of the excess ink to the ink supplies.
FIG. 14 is a schematic illustration of an ink supply system similar to FIG. 13 with the addition of an ink pump, with two four lobe pumping elements, to each printing section for pumping the excess ink from both drains of each section back to the ink supplies.

In some designs, rather than using an ink pan under the anilox roll, the left end excess ink drain is connected to the right end excess ink drain line so that only one ink line returns to the ink supply (shown schematically in FIG. 13). In this event, the excess ink return pump element will again have fewer lobes than the pump element supplying the ink.

It should also be understood that it is preferable to pump the excess ink back to the ink supply rather than rely on a gravity return and to pump it back at a greater volumetric flow rate than the volumetric flow rate at which it is supplied to the print section (referred to as a differential flow rate). Thus, when a separate pump element is used for each of the left side and right side drains, a pump element with at least two lobes is used to supply the ink and two pump elements, each with at least three lobes, are used to pump the excess ink back to the ink supply. The volumetric flow rates of the return elements are each less than the volumetric flow rate of the supply pump element, but combined, their flow rates exceed the flow rate of the supply element. Pumping the ink back at a greater flow rate than that at which it is supplied avoids ink overflow in the end drains (see end drains 18L–18R in FIG. 11) and avoids positive pressure of the ink in closed-chamber doctor blade ink systems (see FIG. 9 and FIG. 12).

At the present time, a conventional diaphragm pump is required for each printing section of a printing machine (of which there may be several) if the ink is returned to the ink supply by gravity return lines. If the ink is to be pumped back to the ink supply, then another such pump is required for each print section, even if the excess ink is drained into a pan or the drain lines are joined as previously described. If the excess ink is pumped separately from each drain, then two additional pumps are required for each section (see FIG. 14). A single pump of the present invention may be configured to pump a different color ink to each of several print sections simultaneously. This is done by running an ink supply line from each color ink supply to a pump element for each color in the pump housing and then connecting an ink supply line from each color pump element to its associated ink section (see FIG. 13). Even if it is desired to pump the excess ink back to the individual ink supplies, only one more pump (with one pump element) for each print section is required if the excess ink flows into a pan or the end drains are joined. If the number of print sections does not exceed three, then a single pump with three pump elements may be used to return the excess ink to the ink supplies. And, the excess ink may be pumped back to the individual ink supplies from the individual end drains by adding one more pump element to the return pump (see FIG. 14) when individual pumps are used for each print section.

The pump 80 is not limited to having only three rotatable pump elements. If it is desired to pump ink to more than three printing sections, the housing and drive shaft parts may be made longer to accommodate more than three pumping elements with the desired number of lobes. In addition, more than two, three, and four-lobed rotors in the pumping elements may be provided (if more than six, the rollers 106 must be made smaller to fit around the flanges 104 or, the flanges 104 must be made larger to accommodate a greater number of rollers 106. If the flanges 104 are made larger, the housing must also be made larger). The advantage of using more lobes is that the volume of ink confined between the compressed portions 126 of tube 120 will be smaller to provide a reduced volumetric flow rate of the ink 120 to the printing sections 10-1 to 10-6 for more precise ink control. Such control is desirable because small and large printing dies 26 may print better when the amount of ink supplied to the printing section is more precisely controlled. If desired, a number of spare rotors, similar to rotors 100 and 110, with different numbers of lobes, may be kept on hand and substituted in a matter of minutes in place of the rotors being used to provide different volumetric flow rates as the need arises.

The uses of the various configurations of the pump described above will become more apparent during the following description of the operation of the pump in connection with the various ink systems.

OPERATION

FIG. 11 schematically illustrates operation of the pump 80 of the present invention in connection with a printing section 10-1 (see FIG. 5) using an anilox roll 12 in cooperation with a doctor roll 14 to apply ink 20 to a printing die 26.

In FIG. 11, three-lobed rotatable pump element 100 of pump 80 pumps ink 20 from an ink supply 40 through an ink supply line 41 to the pumping element 100 and through a supply line 43 to an inlet 45 in the fountain 16 of printing section 10 in the direction of arrows 47 to fill the fountain 16 with ink 20. As the level of ink 36 rises above the top of the dams 18L and 18R, it overflows into the reservoirs 38 from which it drains out of outlets 49L and 49R into ink return lines 42 and 44. Line 42 is connected to the four-lobed rotatable pump element 110 and line 44 is connected to another four-lobed rotatable pump element 110. Pump elements 110 pump the excess ink 20 back to the ink supply 40 through lines 57 and 53. The ink 20 is pumped to the fountain 16 at a first volumetric rate as provided by the three-lobed pumping element 100. The excess ink 20 is pumped from the left side of the fountain 16 at a second volumetric rate, less than the first volumetric rate, as provided by the four-lobed pumping element 110 and, the excess ink 20 is pumped from the right side of the fountain 16 at the the second volumetric rate as provided by the second four-lobed pumping element 110. Since the two second volumetric pumping rates combined are greater than the first volumetric pumping rate of the supply, the ink 20 does not overflow in the open parts of the system. The dams 18L and 18R assure a constant level of ink 20 in the fountain 16.

To clean the pump 80, ink lines 41, 43, 42, 57, 44, and 53, the fountain 16 (including the anilox roll 12, doctor roll 14, and the end dams 18L and 18R), and the ink supply line 41, the pump 80 is run in a reverse direction to pump any ink remaining in line 41 back into the ink supply 40. The ink return lines 57 and 53 merely suck air during reverse rotation of pump 80. Then the supply line 41 is immersed in a fresh supply of cleaning fluid 160 in cleaning fluid supply 162 as indicated by dotted line 164 and the return lines 57 and 53 are placed so as to drain in a sump 166 as indicated by dotted lines 168 and 170. Then the pump 80 is run in a forward direction to pump the cleaning fluid 160 through the parts mentioned above. Preferably, the printing section 10 is run at the same time to expose their ink-bearing surfaces to the cleaning fluid 160.

After the cleaning fluid 160 runs clear as it enters the sump 166, the return lines 57 and 53 are immersed in the cleaning fluid 160 and the supply line 41 is placed so as to drain in the sump 166 and the pump 80 run in a reverse direction to backwash the pump 80 and the supply line 41. After backwashing, a different color ink 20 may be pumped to the printing section 10-1 as set forth above.

The foregoing ink supply and cleaning operation is also applicable to the printing sections 10-2, 10-3, and 10-4 (FIGS. 6, 7 and 8) using an anilox roll in combination with a doctor roll or in combination with any of the single doctor blades described herein or any combination thereof.

The dams 18L and 18R may differ in configuration among the various systems but the net effect is the same.

Figure 12:
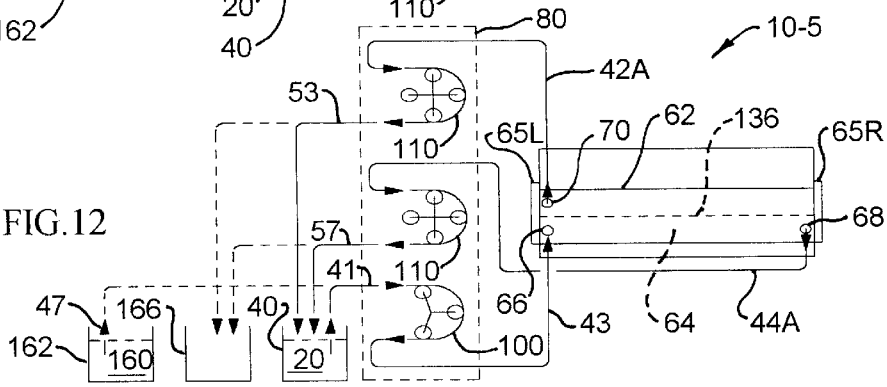
FIG. 12 is a schematic illustration of an ink supply system for an anilox roll/closed-chamber type system using an ink pump with a three-lobed pumping element supplying the ink and two four-lobed pumping elements, one for each drain, pumping excess ink back to the ink supply.

FIG. 12 schematically illustrates operation of the pump 80 of the present invention in connection with a printing section 10-5 (see FIG. 9) using an anilox roll 12 in cooperation with a closed-chamber doctor blade 62 to apply ink 20 to a printing die 26.

In FIG. 12 three-lobed rotatable pump element 100 of pump 80 pumps ink 20 at a first volumetric rate from an ink supply 40 through an ink supply line 41 to the pumping element 100 and through a supply line 43 to an inlet 66 in the fountain 64 of the printing section 10-5 in the direction of arrows 47 to fill the fountain with ink 20. As the ink 20 begins to fill the fountain 64, four-lobed rotatable pump element 110 begins to pump excess ink 20, at a second volumetric rate less than the first volumetric rate, out of the outlet 68 through line 42 back to the pump and from there back to the ink supply 40 through line 51. But, since pumping element 110 pumps less ink than is being supplied to the fountain, the ink level 36 continues to rise until it overflows in outlet 70. Then the second four-lobed rotatable pump element 110 begins to also pump the excess ink 20, at the second volumetric rare, out of the fountain 64 and back to the second pump through line 44 and from the pump element 110 back to the ink supply 40 through line 53. Since the volumetric flow rate of the two four-lobed pumping elements 110 combined exceeds the flow rate of the three-lobed pumping element 100, more excess ink is removed than is supplied and the ink level 36 gradually falls below the outlet 70. Then the rising and falling of the ink level cycle repeats. This results in a neutral or just slightly negative (vacuum) pressure of ink 20 in the fountain 64 thereby reducing leakage of ink through the end seals 65L and 65R.

Cleaning of the parts described in the foregoing paragraph is accomplished in much the same manner as that described in connection with FIG. 11, the difference being that all of the parts can be backwashed. After the cleaning fluid 160 is pumped through the system in the forward direction as previously described, the ink supply line 41 is placed so as to drain in the sump 166 and one of the return lines 51 or 53 is placed in the cleaning fluid supply 162 and the pump 80 run in the reverse direction to backwash the entire system, recognizing that the entire system is closed. Both return lines 51 and 53 should not be placed in the cleaning fluid supply 162 because the volume of cleaning fluid 160 supplied to the fountain 64 with both lines immersed would exceed the volume of cleaning fluid that can be pumped back through the inlet 66 and would force the cleaning fluid through the end seals 65L and 65R and most likely between the doctor blade 64 and anilox roll 12 as well.

FIG. 13 schematically illustrates operation of the pump 80 of the present invention when used to supply ink 20 of a different color to each of three printing sections of any of the types 10-1–10-5 described herein or any combination thereof. Nevertheless, each printing section is identified by numeral 10A, 10B, or 10C in FIG. 13. In this embodiment, pump 80 includes three, three-lobed rotatable pump elements 100A, 100B, and 100C in the pump housing 81. Three separate ink supplies 40 provide three inks 20A, 20B, and 20C, each a different color.

In this embodiment, rotatable pumping element 100A pumps ink 20A through line 41A and through line 43A to outlet 45A in the printing section 10A. The excess ink 20A is returned to the ink supply 40A through return line 44A, the left return line 42A being joined to line 44A as shown. The pumps 100B and 100C are connected to printing sections 10B and 10C respectively in exactly the same manner with the corresponding parts identified by letters B and C as appropriate. Therefore, no further description is deemed necessary.

Cleaning of the parts shown in FIG. 13 is accomplished first by lifting the ink supply lines 41A–C above the ink supplies 40A–C and running the pump 80 in the reverse direction to pump the ink remaining in the rotatable pumping elements 100A–C and in the supply lines 41A–C back to the respective ink supplies. Then, the supply lines 41A–C are immersed in a cleaning fluid 160 in a cleaning fluid supply 162 and the return lines 44A–C placed in a sump 166. The pump 80 is then run in a forward direction to pump the cleaning fluid 160 through the same parts as the ink was pumped until the cleaning fluid flowing into the sump 166 is clear.

Pump 80 is not limited to having only three rotatable pumping elements. If it is desired to pump ink to more than three printing sections, the housing and drive shaft parts may be made longer to accommodate more than three rotatable pumping elements with the desired number of lobes.

In addition, more than two, three, and four lobed pumping elements may be provided (if more than six, the rollers 106 must be made smaller to fit around the rotor flanges 104 or, the flanges 104 must be made larger to accommodate a greater number of rollers 106. If the flanges 104 are made larger, then the housing 81 must also be made larger). The advantage of using more lobes is that the volume of ink confined between the compressed portions 126 of tube 120 will be smaller to provide a reduced volumetric flow rate of the ink 120 to the printing sections 10A–F for more precise ink control. Such control is desirable because small and large printing dies 26 may print better when the amount of ink supplied to the printing section is more precisely controlled. If desired, a number of spare rotors, similar to pumping element rotors 100 and 110, with different numbers of lobes, may be kept on hand and substituted in a matter of minutes in place of the rotors being used to provide different volumetric flow rates as the need arises. The pump of this invention easily provides this versatility.

Although FIG. 13 illustrates a pump 80 for supplying ink to three printing sections simultaneously with gravity returns for the excess ink, if desired, additional pumps 80 may be used to pump the ink back through the return lines. Accordingly, FIG. 14 schematically illustrates operation of the pump 80 of the present invention in the embodiment shown in FIG. 13 with the addition of a pump with only two rotatable pumping elements added to each printing section for pumping the excess ink back to the ink supply.

FIG. 14 uses the same identification numbers as used in FIG. 13 with the addition of numbers for the additional pumps and the return lines from the additional pumps to the ink supplies.

Inks 20A–C are supplied to the printing sections 10A–C as set forth in the operation of the system of FIG. 13. As for the ink return lines 42A–C, instead of going directly to the ink supplies 40A–C, they go to rotatable pump elements 168A–C. Additional ink return lines 174A–C carry the inks 20A–C from the rotatable pump elements to their respective ink supplies 40A–C.

As for the ink return lines 44A–C, instead of going directly to the ink supplies 40A–C, they go to rotatable pump elements 170A–C. Additional ink return lines 176A–C carry the inks 20A–C from the rotatable pump elements to their respective ink supplies 40A–C.

The system shown in FIG. 14 is cleaned by first pumping the inks remaining in the pumps 100A–C back to their respective ink supplies in the manner set forth for the system described in FIG. 13. Then, the ink supply lines 41A–C are immersed in the cleaning fluid supply 162 (the cleaning fluid supply 162 and sump 166 are shown in FIG. 13) and the return lines 174A–C and 176A–C are placed so as to drain into the sump 166. Cleaning fluid 160 is then pumped through the system until the fluid runs clear at the sump.

Thus, the invention having been described in its best embodiment and mode of operation, that which is desired to be claimed by Letters Patent is:

1. Pump means for pumping ink to a printing section of a printing machine, comprising:

a housing means;

a first rotatable pump element within said housing means for pumping said ink to an inlet means in said printing section;

said first rotatable pump element pumps said ink to said inlet means at a first volumetric flow rate;

a second rotatable pump element within said housing means for pumping an excess of said ink from a first outlet means in said printing section; and said second rotatable pump element pumps said excess ink from said first outlet means at a second volumetric flow rate greater than said first volumetric flow rate.

2. The pump means of claim 1 wherein said first rotatable pump element includes:

a first flexible tube means positioned against a curved portion of said housing means for carrying said ink from a first end of said first tube means to a second end of said first tube means; and a first rotor means having at least three equally radially-spaced lobes thereon with each of said lobes coming successively into contact with said first tube means during rotation of said first rotor means with successive pairs of said lobes being operative to press two portions of said first tube means against said curved portion of said housing to confine a first finite volume of said ink in said first tube means, said first rotor means being operative to move successive ones of said first finite volume of said ink from said first end of said first tube means to said second end of said first tube means to provide a substantially constant flow of said ink therein.

3. The pump means of claim 2 wherein said second rotatable pump means includes:

a second flexible tube means positioned against said curved portion of said housing means for carrying said excess ink from a first end of said second tube means to a second end of said second tube means; and a second rotor means having at least two lobes equally radially-spaced thereon with each of said lobes coming successively into contact with said second tube means during rotation of said second rotor means with successive pairs of said lobes being operative to press two portions of said second tube means against said curved portion of said housing means to confine a second finite volume of said excess ink in said second tube means, said second rotor means being operative to move successive ones of said second finite volume of excess ink from said first end of said second tube means to said second end of said second tube means to provide a substantially constant flow of said excess ink therein, said second finite volume of said excess ink being larger than said first finite volume of said ink.

4. The pump means of claim 3 further including:

a drive shaft means within said housing means for supporting at least one of said first rotor means and at least one of said second rotor means for rotation within said housing; and a drive means operatively connected to said drive shaft means for rotating said first and second rotor means at the same rotational velocity.

5. The pump means of claim 4 wherein said drive means includes:

a first gear means secured to an end of said drive shaft means;

a motor means having an output shaft operatively connected to said housing; and a second gear means secured for rotation by said output shaft in meshing engagement with said first gear means for rotating said drive shaft means.

6. The pump means of claim 5 wherein:

said first and second gear means are proportioned to cause said drive shaft means to rotate at a velocity approximately one third the rotational velocity of said output shaft of said motor means.

7. The pump means of claim 4 wherein:

said drive means is operable in a forward direction for pumping said ink to and from said printing section and operable in a reverse direction for pumping ink remaining in said pump means back to an ink supply means prior to cleaning said pump means.

8. The pump means of claim 7 wherein:

said pump means is operable in said forward direction for pumping a cleaning fluid to and from said printing section and operable in said reverse direction for pumping said cleaning fluid through said pump means to backwash said pump means.

9. The pump means of claim 1 further including:

a third rotatable pump element within said housing means for pumping said excess ink from a second outlet means in said printing section.

10. The pump means of claim 9 wherein:

said first rotatable pump element pumps said ink to said inlet means at a first volumetric flow rate;

said second rotatable pump element pumps said excess ink from said first outlet means at a second volumetric flow rate less than said first volumetric flow rate; and said third rotatable pump element pumps said excess ink from said second outlet means at a third volumetric flow rate less than said first volumetric flow rate, the volumetric flow rate of said second and third volumetric flow rates combined exceeding said first volumetric flow rate.

11. Pump means for pumping ink to and from a printing section of a printing machine, comprising:

a housing means;

a first rotatable pump element within said housing means for pumping said ink to an inlet means in said printing section at a first volumetric flow rate, said first rotatable pump element including:

a first rotor means having at least two equally radially-spaced lobes thereon in operative engagement with a first flexible tube means for confining a first finite quantity of said ink between two portions of said tube means compressed by succeeding pairs of said lobes during rotation of said rotor means for moving said first finite quantity of said ink from an inlet end to an outlet end of said first flexible tube means;

a second rotatable pump element within said housing means for pumping an excess of said ink from a first outlet means in said printing section at a second volumetric flow rate less than said first volumetric flow rate; and a third rotatable pump element within said housing means for pumping an excess of said ink from a second outlet means in said printing section at a third volumetric flow rate less than said first volumetric flow rate, the volumetric flow rate of said second and third volumetric flow rates combined exceeding said first volumetric flow rate, said second and third rotatable pump elements each including:

a second rotor means having at least three equally radially-spaced lobes thereon in operative engagement with a second flexible tube means for confining a second finite quantity of said excess ink between two portions of said second tube means compressed by succeeding pairs of said lobes during rotation of said second rotor means for moving said second finite quantity of said excess ink from an inlet end to an outlet end of said second flexible tube means.

12. First pump means for pumping a different color ink to each of several sections of a printing machine comprising:

a housing means;

a first rotatable pump element within said housing means for each of said printing sections for pumping a selected color of said ink to a corresponding printing section to which each of said first rotatable pump means is operably connected;

each of said first rotatable pump elements including, a flexible tube means positioned against a curved portion of said housing means for carrying said ink from a first end of said tube means to a second end of said tube means, a rotor means having at least two equally radially-spaced lobes thereon with each of said lobes coming successively into contact with said tube means during rotation of said rotor means with successive pairs of said lobes being operative to press two portions of said tube means against said curved portion of said housing means to confine a finite volume of said ink in said tube means, said rotor means operatively moving successive ones of said finite volume of said ink from said first end of said tube means to said second end of said tube means to provide a substantially constant flow of said ink therein;

a second pump means for pumping an excess of said ink from each of said several printing sections;

a second housing means; and a second rotatable pump element within said second housing means for each of said several printing sections for pumping said excess ink from an outlet means in each of said printing sections to which said second rotatable pump element is associated.

13. The pump means of claim 12 wherein each of said second pump means includes:

a flexible tube means positioned against a curved portion of said second housing means for carrying said excess ink from a first end of said tube means to a second end of said tube means; and a rotor means having at least three equally radially-spaced lobes thereon with each of said lobes coming successively into contact with said tube means during rotation of said rotor means with successive pairs of said lobes being operative to press two portions of said tube means against said curved portion of said second housing means to confine a finite volume of said excess ink in said tube means, said rotor means being operative to move successive ones of said finite volume of said excess ink from said first end of said tube means to said second end of said tube means to provide a substantially constant flow of said excess ink therein.

14. The pump means of claim 12 further including:

a third pump means for pumping an excess of said ink from each of said several printing sections, comprising:

a third housing means; and a third rotatable pump element within said third housing means for each of said several printing sections for pumping said excess ink from a second outlet means in each said printing section to which said third rotatable pump element is associated.

15. The pump means of claim 14 wherein each of said third rotatable pump elements includes:

a flexible tube means positioned against a curved portion of said third housing means for carrying said excess of said ink from a first end of said tube means to a second end of said tube means; and and a rotor means having at least three equally radially-spaced lobes thereon with each of said lobes coming successively into contact with said tube means during rotation of said rotor means with successive pairs of said lobes being operative to press two portions of said tube means against said curved portion of said third housing means to confine a finite volume of said excess ink in said tube means, said rotor means being operative to move successive ones of said finite volume of said excess ink from said first end of said tube means to said second end of said tube means to provide a substantially constant flow of said excess of said ink therein.

16. The pump means of claim 15 wherein:

said first pump means pumps said selected color of said ink to said printing section at a first volumetric flow rate;

said second pump means pumps said excess ink from said outlet means of said printing section at a second volumetric flow rate less than said first volumetric flow rate; and said third pump means pumps said excess ink from said second outlet means of said printing section at a third volumetric flow rate less than said first volumetric flow rate, the volumetric flow rate of said second and third volumetric flow rates combined exceeding said first volumetric flow rate.

17. Pump means for pumping ink to and from a printing section of a printing machine wherein said printing section includes a closed-chamber doctor blade means having an inlet means for receiving said ink, a first outlet means for discharging an excess of said ink and, a second outlet means above said first outlet means for discharging said excess of said ink, said pump means comprising:

a housing means;

a first rotatable pump element within said housing means for pumping said ink to said inlet means at a first volumetric flow rate;

a second rotatable pump element within said housing means for pumping said excess of said ink from said first outlet means at a second volumetric flow rate less than said first volumetric flow rate; and a third rotatable pump element within said housing means for pumping said excess of said ink from said second outlet means at a third volumetric flow rate less than said first volumetric flow rate when said ink in said closed-chamber doctor blade means rises to the height of said second outlet means, the volumetric flow rate of said second and third flow volumetric flow rates combined exceeding said first volumetric flow rate for preventing a positive pressure of said ink in said closed-chamber doctor blade means.

18. The pump means of claim 17 wherein:

rotation of said first rotatable pump element is reversible for pumping ink remaining therein back to an ink supply prior to cleaning said pump means.

19. The pump means of claim 18 wherein:

said pump means is operable for pumping a cleaning fluid in a forward direction for cleaning said pump means and said closed-chamber doctor blade means and for pumping said cleaning fluid in a reverse direction for backwashing said pump means and said closed-chamber doctor blade means.

* * * * *